United States Patent [19]

Eckman

[11] Patent Number: 4,631,992

[45] Date of Patent: Dec. 30, 1986

[54] SCREWDRIVER

[75] Inventor: Richard E. Eckman, Houston, Tex.

[73] Assignee: Dresser Industries, Inc., Dallas, Tex.

[21] Appl. No.: 838,204

[22] Filed: Mar. 10, 1986

Related U.S. Application Data

[63] Continuation of Ser. No. 616,364, Jun. 1, 1984, abandoned.

[51] Int. Cl.[4] ..... B25B 23/151

[52] U.S. Cl. ..... 81/470; 81/469; 81/472; 81/473

[58] Field of Search ..... 81/470, 469, 472, 473, 81/467; 173/12, 15

[56] References Cited

U.S. PATENT DOCUMENTS

| | | | |
|---|---|---|---|
| 3,289,715 | 12/1966 | Groff et al. | 81/470 |
| 3,596,542 | 8/1971 | Wallace | 81/470 X |
| 3,811,513 | 5/1974 | Wezel et al. | 173/12 |

*Primary Examiner*—Frederick R. Schmidt
*Assistant Examiner*—Bradley I. Vaught

[57] ABSTRACT

A power drive screwdriver that is constructed to automatically stop when a predetermined torque is reached. The screwdriver includes a housing having a pneumatically driven motor therein and an output shaft that is linked to the screwdriver bit through a releasable clutch. A control valve is positioned in the housing to control air flow to the motor. The position of the valve is controlled by a rod that extends through the shaft. A transverse slot extends through the shaft intersecting the bore therein and the transverse slot contains a pair of balls that are retained within the slot by a sleeve encircling the exterior of the shaft. Further, a reset member engages the screwdriver bit and also engages the balls to displace the balls in the slot in a direction to open the valve. When the predetermined torque is encountered, the sleeve moves upwardly, permitting the balls to separate and thereby letting the valve rod move to permit the valve to close.

3 Claims, 7 Drawing Figures

SCREWDRIVER

This application is a continuation of application Ser. No. 616,364, filed June 1, 1984, now abandoned.

BACKGROUND OF THE INVENTION

This invention relates generally to improved screwdrivers. More particularly, but not by way of limitation, this invention relates to an improved screwdriver driven by a pneumatic motor and including a torque-actuated shut-off mechanism and automatic reset.

Screwdrivers of the type described hereinafter are generally utilized in production work. In such work, the screwdrivers are preset to drive a threaded fastener into a workpiece up to a predetermined torque. Various arrangements have been proposed in the past to provide accurate and repetitive shut-off mechanisms in such screwdrivers.

U.S. Pat. Nos. 3,766,990, issued Oct. 23, 1973, to Richard E. Eckman et al entitled "Low Torque Automatic Screwdriver" and 4,154,308, issued May 15, 1979, to Emory G. Goldsbury et al and also entitled "Low Torque Automatic Screwdriver," propose one type of such shut-off and reset mechanism that has been successfully operated.

U.S. Pat. No. 3,811,513, issued May 21, 1974, to Hans Wezel et al and entitled "Portable Pneumatic Power Tool," proposes a different type of automatic shut-off mechanism. In the mechanism proposed by Wezel, a pair of balls are constrained within a drive shaft by a sleeve that encircles the drive shaft. The balls engage a valve actuating rod to prevent the rod from moving toward the tool bit and preventing the valve from closing until a predetermined torque has been reached. When this occurs, the sleeve is moved to a position wherein the balls can separate slightly, permitting the valve rod to move toward the tool bit and permitting the valve to close. While this tool apparently operates satisfactorily, it is believed that a more positive shut-off mechanism and reset therefor will greatly enhance the tool.

Therefore, an object of this invention is to provide an improved screwdriver including a positive shut-off and reset mechanism that is accurate and repeatable and one in which the shut-off mechanism can be quickly and easily reset to permit additional operation of the screwdriver.

SUMMARY OF THE INVENTION

This invention then provides an improved screwdriver that includes a housing, a pneumatic motor in the housing, a valve for controlling air to the motor, a tool bit driven by the motor, and a clutch interposed between the motor and tool bit wherein the clutch is operable in response to a predetermined torque imposed on the tool bit to effectively disengage the motor and tool bit. The improvement comprises drive means that includes a drive shaft connecting the clutch and motor, wherein the shaft has a longitudinal bore extending therethrough and has a transverse slot therein intersecting the bore. The slot has a longitudinal dimension that is greater than the radius of the shaft. A pair of balls are disposed in the slot with each ball having a diameter substantially equal to the radius of the shaft. A valve rod is movably located in the bore and has a first end in engagement with the valve and a second end that engages the balls. A reset pin extends through the shaft and has one end in engagement with the tool bit and the other end in engagement with the balls. The pin is movable in the shaft by the tool bit to move the balls and valve rod to a position wherein the valve is open. A sleeve member encircles the shaft adjacent to the slot and has a first portion of a diameter substantially equal to the outside diameter of the shaft to hold the balls in engagement and has a second portion of a diameter slightly larger than the shaft whereby the balls separate, when adjacent thereto, permitting the valve rod to move toward the tool bit and close the valve. A spring encircles the shaft in engagement with the sleeve member, biasing the sleeve member toward the position wherein the smaller diameter portion of the sleeve is adjacent to the balls and the screwdriver is in condition to be reset for additional operation.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
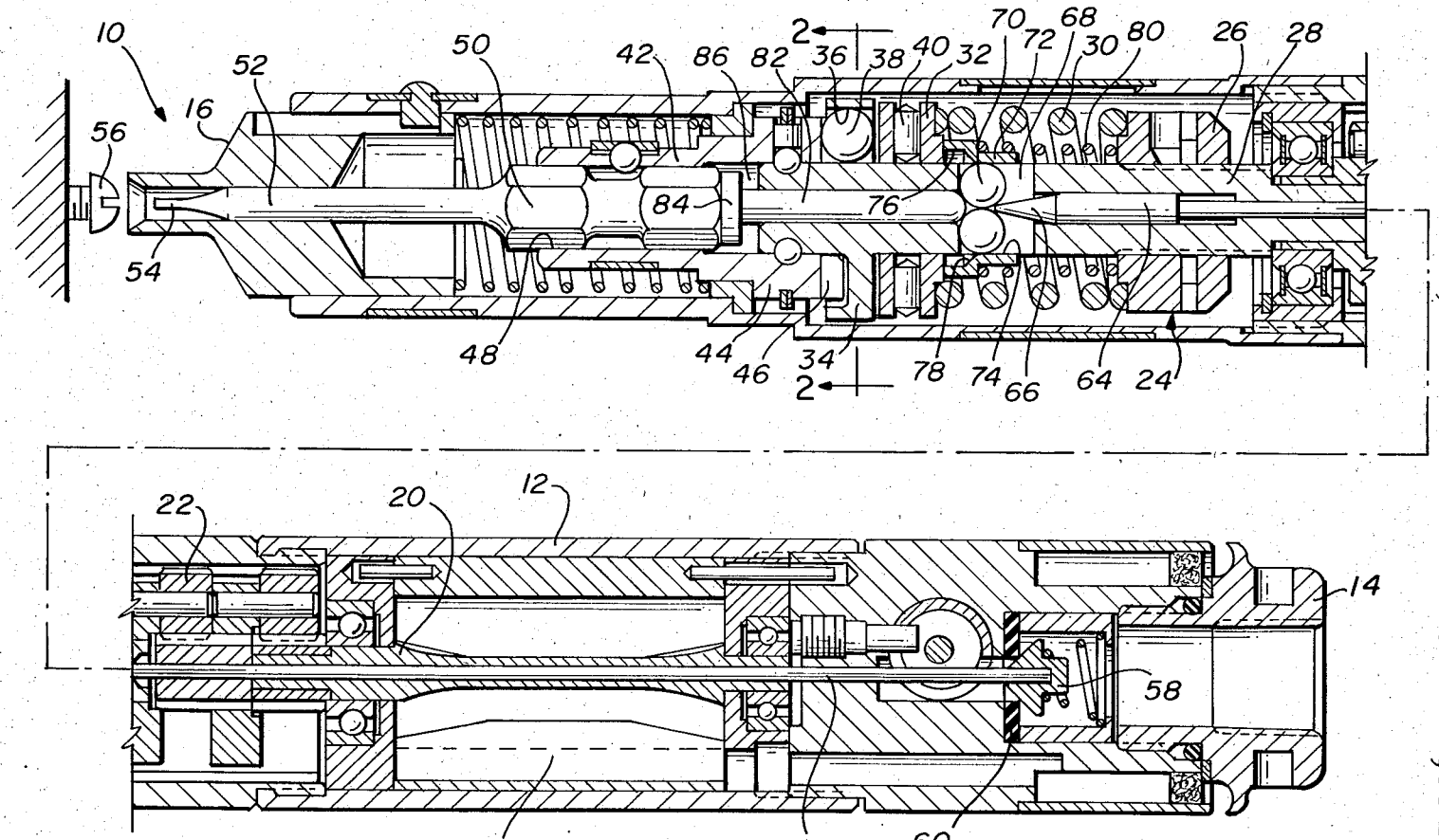
FIG. 1 is a cross-sectional view of the improved screwdriver constructed in accordance with the invention.

Referring to the drawing, and FIG. 1 in particular, shown therein and generally designated by the reference character 10 is a screwdriver that is constructed in accordance with the invention. The screwdriver 10 includes a hollow housing or body 12 having in one end a fitting 14 that is suitable for connection with an air supply. At the opposite end of the housing 12, the screwdriver 10 is provided with a spring-loaded screw finder 16 that is reciprocable in the housing 12.

The screwdriver 10 also includes a pneumatic motor 18 having an output shaft 20 that is interconnected by a reduction gear system 22 to a torque-actuated clutch that is generally designated by the reference character 24.

The clutch 24 includes a torque adjusting nut 26 that is threadedly attached to a drive shaft 28. The adjusting nut 26 is provided so that the predetermined torque to be imposed by the screwdriver 10 can be set to the value desired. The nut is in engagement with a torque spring 30 which has its lowermost end (left end as seen in FIG. 1) in engagement with a torque spring plate 32.

Figure 2:
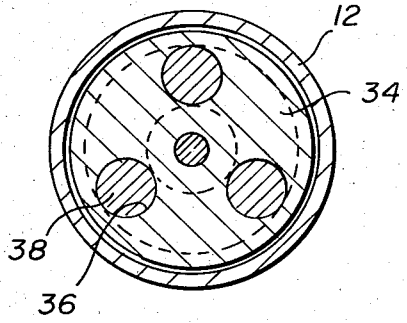
FIG. 2 is a transverse cross-sectional view taken along the line 2—2 of FIG. 1.

An annular clutch ball flange 34 projects radially outwardly from the drive shaft 28. The flange 34 includes openings 36 that are provided therein to receive a plurality of clutch balls 38 (see also FIG. 2). A thrust bearing 40 is located between the flange 34 and the torque spring plate 32.

Figure 3:
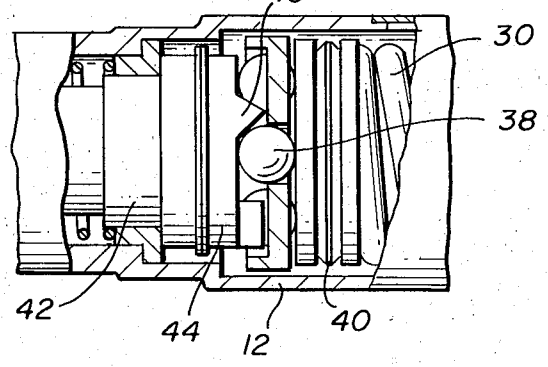
FIG. 3 is a fragmentary view illustrating in elevation a portion of the screwdriver of FIG. 1.

To transmit torque from the drive shaft 28 into a spindle 42, the end of the spindle adjacent to the balls 38 is provided with an annular clutch portion 44. A plurality of cams 46 are formed on the portion 44, as can be seen more clearly in FIG. 3 drivingly engaging the clutch balls 38.

The spindle 42 has a generally hexagonal interior 48 that drivingly receives the hexagonal exterior 50 of a screwdriver bit 52. Thus, so long as the clutch 34 remains in the position illustrated in FIG. 1, rotation is transmitted from the drive shaft 28 through the clutch 34 into the spindle 42 and then into the tool bit 52. It will be noted that the screwdriver bit 52 projects through the screw locater 16 and has a blade 54 thereon suitable for engagement with a threaded fastener 56.

Inside the housing 12 of the screwdriver 10 and adjacent to the fitting 14 there is a spring-biased shut-off valve 58. In FIG. 1 the valve 58 is shown in sealing engagement with a valve seat 60, thus preventing air from entering the motor 18. A valve control rod 62 extends through the screwdriver 10 passing through the shaft 20, the motor 18 and through a portion of the drive shaft 28. As illustrated, the valve control rod 62 is provided with an end portion 64, which may be a separate member, that terminates in a conical end 66.

The end 66 is disposed in a transversely extending slot 68 that is formed in the drive shaft 28. Disposed in the slot 68 are a pair of balls 70. Each of the balls 70 has a diameter that is equal to the radius of the drive shaft 28. It will also be noted that the slot 68 has a longitudinal dimension that is greater than the diameter of the balls 70 so that the balls 70 can move longitudinally therein. The balls 70 are retained in the slot 68 by a sleeve 72 that encircles the drive shaft 28.

The sleeve 72 includes a portion 74 that is of substantially the same diameter as the diameter of the drive shaft 28, and thus prevents the balls 70 from moving apart or outwardly of the slot 68. The sleeve also includes a portion 76 having a diameter larger than the shaft 28 whereby the balls 70 can move relatively apart as will be described. An intermediate portion 78 is disposed at an angle relative to the portions 74 and 76. The sleeve 72 is urged toward the position illustrated in FIG. 1 by a spring 80 that encircles the drive shaft 28 in engagement with the torque adjusting nut 24 and the sleeve 72.

A reset rod 82 extends longitudinally through the portion of the drive shaft 28 between the rod 62 and the bit 52. An end 84 of the reset pin 82 is in engagement with the screwdriver bit 52 and the opposite end thereof is in engagement with the balls 70. It will be noted that the end 84 on the reset rod 82 is positioned in a space 86 between the bit 52 and the shaft 28. Accordingly, the reset rod 82 can move axially, to a limited extent, relative to the drive shaft 28.

OPERATION OF THE PREFERRED EMBODIMENT

As illustrated in FIG. 1, the components of the pneumatic screwdriver 10 are in the positions that they occupy before the screwdriver 10 is turned on, that is, before the motor 18 is starte to cause the bit 52 to rotate. When in this position, the cam balls 38 are in the positions illustrated in FIGS. 1 and 3 with the balls 38 in engagement with the cams 46 on the clutch portion 44.

Figure 4:
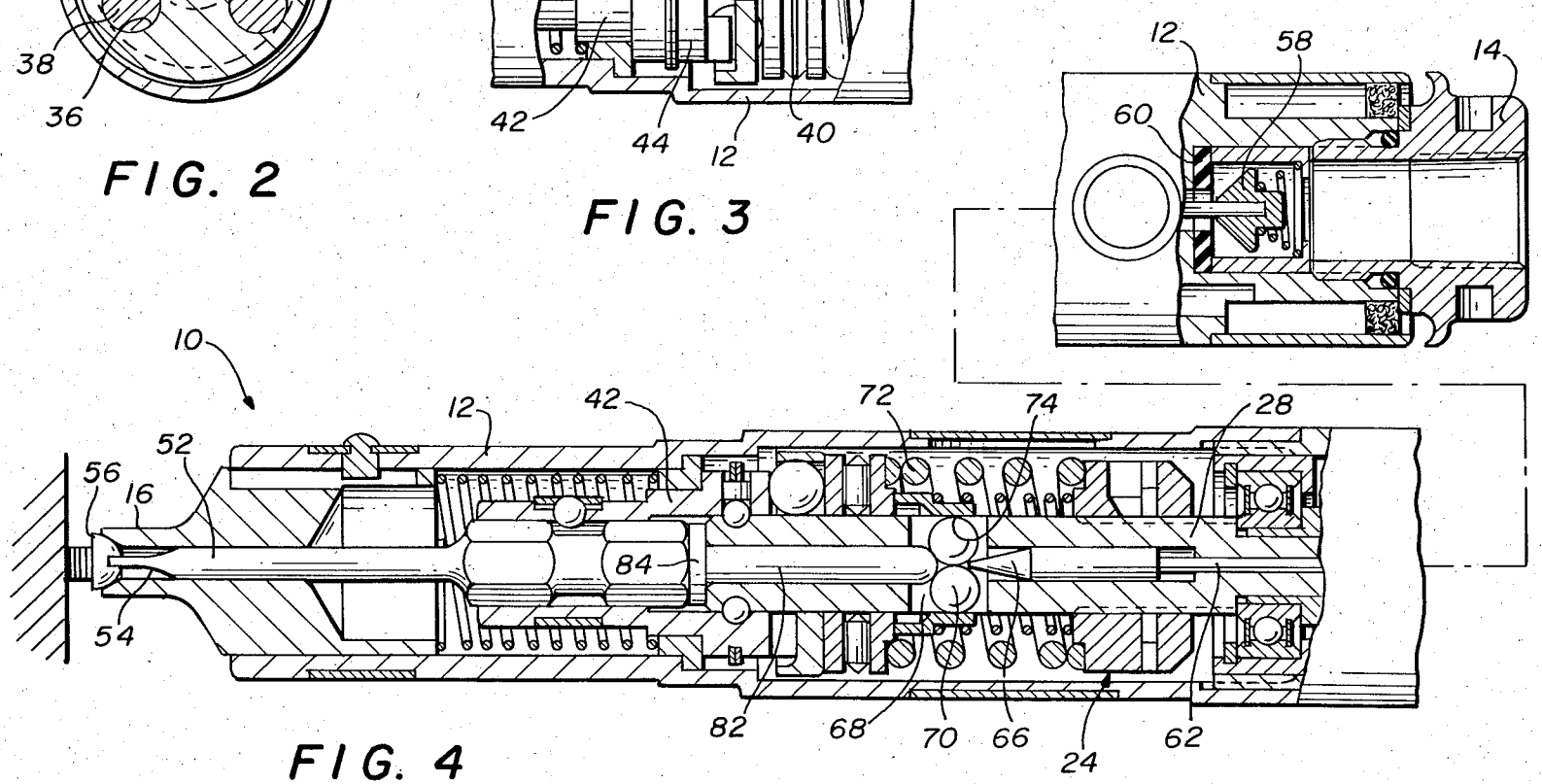
FIG. 4 is a view similar to FIG. 1, but illustrating the screwdriver in a different operating condition.

The motor 18 is started when the screwdriver blade 52 is in engagement with the threaded fastener 56 as illustrated in FIG. 4. As shown therein, the locater 16 is in engagement with the threaded fastener 56, guiding the blade 54 of the screwdriver bit 52 into the slot in the threaded fastener 56. Pressure applied on the housing 12 forces the screwdriver housing 12 toward the threaded fastener 56 causing the screwdriver blade 52 to move relatively to the right as illustrated in FIG. 4. This movement engages the reset rod 82 which moves the balls 70 longitudinally within the slot 68 in the shaft 28. When this happens, the valve operating rod 62 is also moved, forcing the valve member 58 off the valve seat 60 and permitting air under pressure to flow from the fitting 14 into the motor 18.

As the motor 18 rotates, the drive shaft 28 rotates, causing the clutch 24 to rotate, and through the arrangement between the ball flange 34, the balls 38, and the cams 46, causes the rotational movement to be transmitted to the sleeve 42 and through its hexagonal interior 48 to the screwdriver blade 52.

Figures 5, 6, 7:
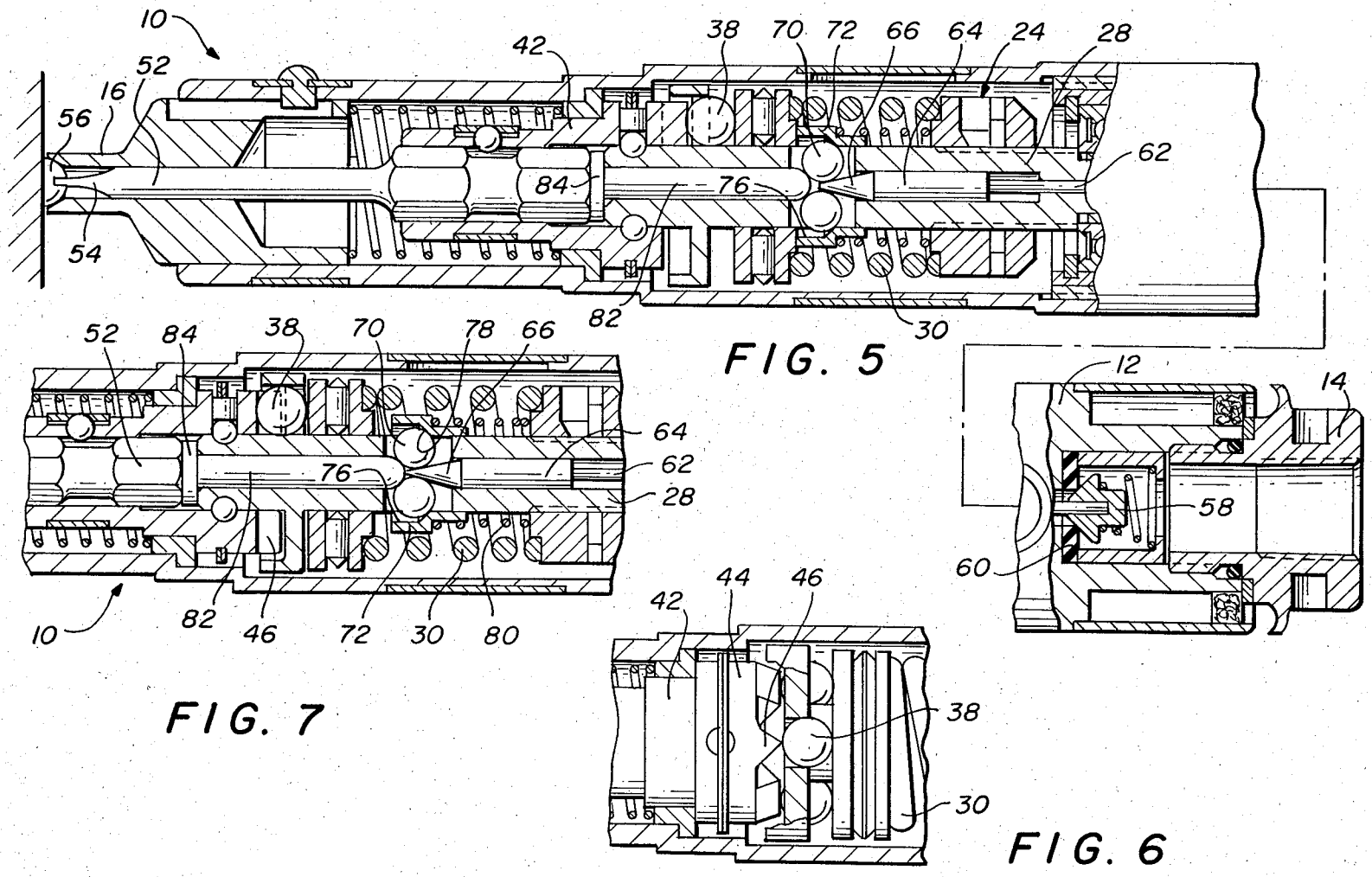
FIG. 5 is also a view similar to FIG. 1, but illustrating the screwdriver in still another operating condition.
FIG. 6 is a view similar to FIG. 3, but illustrating the clutch mechanism in position for the operating condition of FIG. 5.
FIG. 7 is a fragmentary cross-sectional view illustrating a portion of the screwdriver of FIG. 1 in still another operating position.

When the threaded fastener 56 is tightened to the predetermined torque previously set in the screwdriver 10, the screwdriver bit 52 ceases to rotate, holding the sleeve 42 fixed. Continued rotation of the drive shaft 28 by the motor 18 causes the clutch balls 38 to ride up on the cams 46 of the clutch member 44 to the positions illustrated in FIG. 6. When this occurs, the torque spring plate 20 is displaced to the right as shown in FIG. 5, carrying the sleeve 72 into the position wherein the balls 70 can move apart, moving outwardly into the larger diameter portion 76 of the sleeve 72 and allowing the conical point 66 on the valve operating rod 62 to move therebetween. The spring biased valve member 58, under the influence of the spring in the valve and under the influence of air flowing through the valve, moves into sealing engagement with the valve seat 60, shutting off the flow of air to the air motor 18 and stopping rotation of the shaft 28.

The clutch balls 38 move to one side or the other of the cams 46 since the cams are essentially pointed, returning the clutch 34 to the drive position as illustrated in FIG. 7. The balls 70 in the slot 68 are in engagement with the tapered or cam surface of the intermediate portion 78 of the sleeve 72. The angular disposition of this surface causes the balls 70 to be cammed relatively together and, due to the force exerted by the spring 80, to return the reset member 82 to the left, restoring the screwdriver bit 52, and the balls 70 to the positions illustrated in FIG. 1. It will be noted that the valve operating rod 62 does not move since it is in the FIG. 1 position when the valve 58 is in the closed position as discussed in connection with FIG. 5. With the various components of the screwdriver 10 in the positions described, the screwdriver 10 has been automatically reset and is read to be placed upon another threaded fastener for additional operation of the screwdriver. The conical point 66 on the operating rod 62 aids in returning the various components to the reset position, since the surface of the conical point acts as a tapered cam that operates in conjunction with the tapered surface on the intermediate portion 78 of the sleeve 72.

From the foregoing detailed description, it will be appreciated that the screwdriver described hereinbefore, due to its configuration, is inherently balanced, that the screwdriver can be set to operate efficiently and at repetitive desired torques, and that the screwdriver resets quickly and effectively to permit continued automatic operation of the screwdriver.

The single embodiment described in detail hereinbefore is presented by way of example only and it will be understood that many changes and modifications can be made thereto without departing from the spirit and scope of the annexed claims.

What I claim is:

1. In an improved screwdriver that includes a housing, a pneumatic motor in said housing, a valve for controlling air to the motor, a tool bit driven by the motor, and a clutch interposed between the motor and tool bit, said clutch being operable in response to a predetermined torque imposed on said tool bit to effectively disengage said motor and tool bit, the improvement comprising:

drive means including a drive shaft connecting said clutch and motor, said shaft having a longitudinal bore extending therethrough and having a transverse slot therein intersecting said bore, said slot having a longitudinal dimension graater than the radius of said shaft;

a pair of balls disposed in said slot, each said ball having a diameter substantially equal to the radius of said shaft;

a valve rod movably located in said bore and having a first end engaging said valve and a second end engaging said balls;

a valve actuating pin extending through said shaft and having one end engaging the tool bit and the other end engaging said balls, said pin being movable in said shaft by said tool bit to move said balls and valve rod to a position opening said valve;

a sleeve member encircling said shaft adjacent to said slot, said sleeve member having a first portion of a diameter substantially equal to the outside diameter of said shaft whereby said balls are held in engagement, a second portion of a diameter slightly larger than said shaft whereby said balls can separate when adjacent thereto permitting said valve rod to move toward said tool bit and said valve to close stopping the air supply to said motor, and having a cam portion between said first and second portions, said cam portion including a frustoconical surface for engaging said balls; and, resilient means for biasing said sleeve member toward the position wherein said first portion is adjacent to said balls, the cam portion on said sleeve member engaging said balls to move said balls inwardly and downwardly in said slot and to move said rod downwardly resetting said screwdriver for additional operation.

2. In the screwdriver of claim 1 wherein said second end on said valve rod is tapered.

3. An improved pneumatically-powered screwdriver comprising, in combination:

a hollow screwdriver housing having first and second ends;

a pneumatic motor in said housing having an output shaft;

gear reduction means in said housing connected with said output shaft;

torque-actuated clutch means in said housing for driving a tool bit rotatably supported in and extending from the first end of said housing;

said clutch means including a hollow drive shaft arranged to be driven by said gear reduction means, a clutch spring encircling said drive shaft and having one end adjustably engaged therewith, and a hollow spindle receiving said tool bit for driveably engaging said drive shaft and releaseable therefrom upon the application of a predetermined torque to said tool bit and spindle;

valve means for controlling the flow of pressurized air to said motor, said valve means being located adjacent to the second end of said housing and including a valve member moveable to an open position and constantly biased toward a closed position;

a valve rod in said hollow drive shaft having a first end engaging said valve member for moving said valve member to said open position;

a slot in said drive shaft within said spring, said slot having a length greater than the radius of said drive shaft;

a pair of balls disposed in said slot in engagement with a second end of said valve rod, each said ball having a diameter substantially equal to the radius of said drive shaft;

a valve actuating pin moveably located in said spindle with one end engaging said balls and the other end engaging said tool bit whereby movement of said tool bit and valve actuating pin toward the second end of said housing shifts said balls in said slot and valve rod in said drive shaft toward the second end of said housing to move said valve member to the open position to permit air flow to said motor;

a sleeve encircling said drive shaft adjacent to said slot and in engagement with a portion of said clutch means, said sleeve including a first portion having an inner diameter substantially the same as the drive shaft, a second portion having a larger inner diameter, and an annular beveled cam portion therebetween, said sleeve being moveable along said shaft when said clutch is released to move the larger inner diameter of said sleeve adjacent to said balls whereby said balls can move radially out of engagement with said valve rod permitting said valve member to move to the closed position stopping the flow of air to said motor; and, spring means encircling said drive shaft within said clutch spring for moving said sleeve, actuating pin and balls in said slot toward the first end of said housing, camming said balls inwardly preventing said balls from moving outwardly and for retaining said balls in engagement with the second end of said valve rod, whereby said screwdriver is reset for additional operation.

* * * * *